United States Patent [19]

Goldstein

[11] Patent Number: 4,890,265

[45] Date of Patent: Dec. 26, 1989

[54] INFRA-SONIC DETECTOR AND ALARM WITH SELF ADJUSTING REFERENCE

[75] Inventor: Steven G. Goldstein, Los Angeles, Calif.

[73] Assignee: Rabbit Systems, Inc., Santa Monica, Calif.

[21] Appl. No.: 228,530

[22] Filed: Aug. 3, 1988

[51] Int. Cl.[4] ..... G08B 13/22

[52] U.S. Cl. ..... 367/94; 200/61.62; 307/116; 307/141; 340/566

[58] Field of Search ..... 367/93, 94; 340/566, 340/614, 63, 522, 523, 524, 565; 307/141, 116, 118; 200/61.62

[56] References Cited

U.S. PATENT DOCUMENTS 4,468,763 8/1984 Braunling et al. ..... 340/566 X 4,586,031 4/1986 Grinneiser ..... 340/614 X 4,800,293 1/1989 Miller ..... 340/566 X

*Primary Examiner*—Gerard R. Strecker

*Assistant Examiner*—Robert W. Mueller

*Attorney, Agent, or Firm*—Irell & Manella

[57] ABSTRACT

A detector and alarm is provided for monitoring air pressure variations in a monitored space, which variations correspond to an intrusion. An infra-sonic detector includes a microphone or the like and a low pass filter to retain only low frequency infra-sonic signals. The instantaneous infra-sonic signals are compared against a variable reference signal, which is a voltage lagging or delayed variant of the instantaneous signals. In this manner the detector is self adjusting for slow variations in the instantaneous signals but responds immediately to rapid variations to trigger an alarm.

5 Claims, 1 Drawing Sheet

INFRA-SONIC DETECTOR AND ALARM WITH SELF ADJUSTING REFERENCE

BACKGROUND OF THE INVENTION

This invention relates to an infra-sonic alarm system for monitoring an enclosed area, such as the interior of an automobile, and providing an alarm signal when the integrity of the enclosed area is violated by an intruder.

The prior art is replete with detectors and alarms for monitoring enclosed areas including automobiles. Such detectors and alarms operate on various principles, including infrared and ultrasonics. These devices each have their advantages and disadvantages, which are well known to those working in the field of alarm or monitoring systems.

There exists U.S. Pat. No. 4,586,031 directed towards what is described as an infra-sonic detector and alarms using such a detector. The infra-sonic detector disclosed in this patent is disclosed as a microphone or other suitable detector for detecting air pressure variations, which is associated with filtering means for extracting the low frequency sounds of interest, which are below 20 Hz. The circuit and alarm arrangement of that patent includes a threshold circuit for comparing the signal from the low pass filter arrangement to a fixed reference to generate a trigger signal for activating an alarm. A manual sensitivity control is provided for adjusting the level of the fixed reference.

In the arrangement disclosed in U.S. Pat. No. 4,586,031, there is a description of various bands of frequencies, ranging from below 0.3 Hz to above 4.5 Hz. The patent contemplates providing sensing in these various bands of frequencies in order to avoid false alarms and the like. The patent states that: "The use of the B [0.3–0.7 Hz] and C [0.7–1.8 Hz] bands obviates any difficulties from very slow pressure variations (temperature rise of a vehicle situated in full sunlight, change from daytime to nighttime conditions, and so on) and fast variations (e.g. infra-sonics of the frequencies of bands D [1.8–4.5 Hz] and E [above 4.5 Hz] produced by a vehicle passing nearby)."

OBJECTS AND SUMMARY OF THE INVENTION

It is an object of this invention to provide an improved infra-sonic detector and alarm which minimizes false alarms.

It is a more specific objective of this invention to provide an infra-sonic detector and alarm which compares an instantaneous detector signal against a variable time-lagging reference signal for inhibiting slow-varying air pressure changes in a monitored area for causing a false alarm, and which is therefore self-adjusting.

Briefly, in accordance with one embodiment of the invention, a sensor such as a microphone which is sensitive to air pressure variations is disposed within an enclosed area which is to be monitored, such as the interior of an automobile. The sensor's output is amplified and filtered through a low-pass filter which passes only infra-sonic signals. The filtered infra-sonic signal is split into two signal paths, which are applied to two inputs of a comparator. One of the signal paths serves as a variable reference and includes a time delay. In this manner, the detector is self adjusting so that only rapidly changing infra-sonic signals cause an alarm output from the comparator. By using such a variable reference technique, enhanced detector sensitivity is achieved while avoiding false alarms.

DETAILED DESCRIPTION

Figure 1:
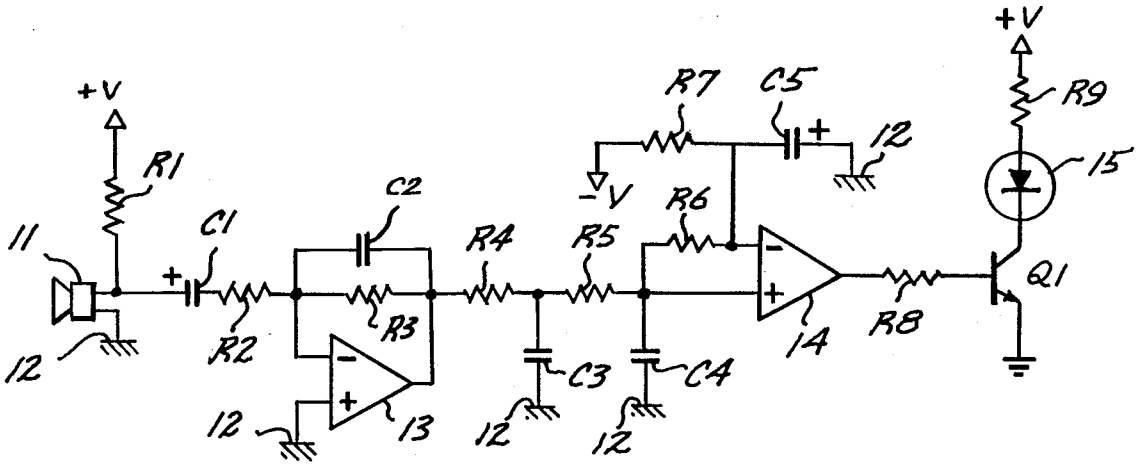
FIG. 1 shows a circuit diagram for one embodiment of an infra-sonic detector and alarm in accordance with a preferred embodiment of the invention.

Turning now to a discussion of the drawings, FIG. 1 illustrates the basic circuit of an infra-sonic detector and alarm in accordance with a preferred embodiment of the invention. An electret microphone 11 is biased through a resistor R1 to a source of voltage +V against an artifical ground 12 (discussed below in connection with FIG. 2). The output of the electret microphone 11 is A.C. coupled through a capacitor C1 and a resistor R2 to an inverting input of an amplifier 13. The non-inverting input of amplifier 13 is biased to the artificial ground 12 (power supply center). A capacitor C2 and resistor R3 are connected between the inverting input of amplifier 13 and its output, with capacitor C3 providing low pass filtering and stabilizing the amplifier 13 against possible oscillations. The value of the capacitor C3 can be selected to, for example, pass signals below 3 KHz. In accordance with a preferred embodiment of the invention, the amplifier 13 is selected to have a gain of 80.

In FIG. 1 the network formed by resistor R4, capacitor C3, resistor R5, and capacitor C4 forms a two pole low-pass filter. In accordance with a preferred embodiment o the invention this network has a 1.5 Hz cut-off, which functions to extract the infra-sonic component from the amplified signal.

The infra-sonic signal output of the two pole low-pass filter network is presented to both inputs of a comparator 14. The non-inverting input to the comparator 14 receives the instantaneous infra-sonic output of the filter network. The inverting input to the comparator 14 is used as a variable reference against which the instantaneous infra-sonic signal is compared. The resistors R6 and R7 cause the signal at the inverting input to the comparator 14 to be somewhat higher than the input at the non-inverting input, approximately 16% higher in accordance with one embodiment. THerefore, in a quiescent state, the non-inverting input is higher, resulting in a first state for the output of comparator 14. A capacitor C5 is coupled to the inverting input to comparator 14 and functions to cause the inverting input to be voltage lagging, i.e. time delayed inasmuch as rapid increases in the signal at the inverting input charge up capacitor C5.

For very slow voltage variations of the infra-sonic signal output of the low pass filter, the relationship between the two inputs of the comparator 14 (non-inverting somewhat lower than inverting) remains the same, and the comparator's output does not switch. But for rapid positive going excursions of the infra-sonic signal from the low pass filter, the inverting input lags significantly behind the non-inverting input because of the capacitor C5, enabling the non-inverting input to become more positive than the inverting input with a resulting change of state at the comparator's output to generate a trigger signal.

The change of state output of comparator 14 constitutes a trigger signal that can be utilized to activate an alarm of whatever type is desired. As an example, in FIG. 1 the comparator output is shown as coupled through a resistor R8 to drive a transistor Q1 having an alarm circuit such as a light emitting diode 15 and a resistor R9.

Of course, audible alarm indicators such as a siren or horn or the like can be provided instead of or in addition to a visual indicator.

Figure 2:
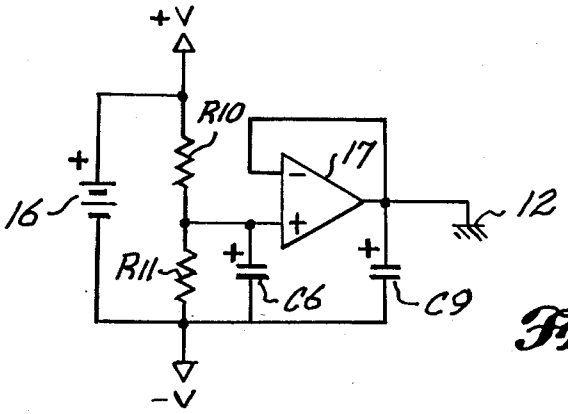
FIG. 2 shows a circuit diagram for a power supply for the circuit of FIG. 1.

FIG. 2 shows the circuit diagram of the power supply for the circuit of FIG. 1. In FIG. 2, a battery 16 which may, for example, be a 6 volt battery, is connected across a network formed by resistors R10 and R11 to provide voltages +V and −V as shown. The midpoint between resistors R10 and R11 is an input to an operational amplifier 17, stabilized by capacitors C6 and C7. The output of the operational amplifier is the artificial ground 12. This power supply circuit provides very accurate and stable reference voltages +V and −V for insuring stable and accurate operation of the detector and alarm circuit of FIG. 1.

In accordance with a particular embodiment of the circuits of FIG. 1 and FIG. 2, the values of the circuit elements illustrated are as follows:

| | |
|---|---|
| R1 - 1K ohms | C1 - 4.7 mf. |
| R2 - 47K ohms | C2 - 22 pf. |
| R3 - 2.2 M ohms | C3 - 2.2 mf. |
| R4 - 47K ohms | C4 - .33 mf. |
| R5 - 300K ohms | C5 - 1 mf. |
| R6 - 1 M ohms | C6 - 10 mf. |
| R7 - 10 M ohms | C7 - 10 mf. |
| R8 - 10K ohms | |
| R9 - 1K ohms | |
| R10 - 100K ohms | |
| R11 - 100K ohms | |

While the invention has been illustrated and described with respect to a particular embodiment, it should be clearly understood that it is not thereby intended to limit the invention to that particular embodiment, and that variations may be made by those skilled in this art without departing from the true spirit and scope of this invention.

I claim:

1. An infra-sonic detector and alarm system for detecting intrusion in a monitored air space comprising:

a transducer for sensing instantaneous air pressure variations in the monitored space and producing an electrical pressure variation signal;

amplifier means for amplifying the electrical pressure variation signal;

low pass filter means for passing only infra-sonic portions of the electrical pressure variation signal;

a reference circuit having means for delaying and averaging the instantaneous infra-sonic portions of the electrical pressure variation signal to generate a short term averaged reference signal;

comparator means for comparing the instantaneous infra-sonic signal portions of the electrical pressure variation signal to said short term averaged reference signal for generating a trigger signal when said instantaneous infra-sonic portions exceed the short term averaged reference signal; and alarm means activated by said trigger signal.

2. An infra-sonic detector in accordance with claim 1 wherein said comparator means has a monitoring signal input and a short term averaged reference signal input, with said instantaneous infra-sonic signal portions being applied to both said monitoring signal input and said short term averaged reference signal input through impedance means such that the short term averaged reference signal input normally exceeds the monitoring signal input to produce a first comparator output state, and including voltage delay means coupled to the short term averaged reference signal input, whereby only rapid changes in the instantaneous infra-sonic signal portions cause the monitoring signal input to the comparator to exceed the short term averaged reference input to thereby cause a change of state of the comparator output to a second state corresponding to a trigger signal.

3. An infra-sonic detector in accordance with claim 2 wherein said voltage delay means comprises a capacitor.

4. An infra-sonic detector in accordance with claim 2 wherein said transducer comprises an electret microphone and wherein said low-pass filter means passes only infra-sonic signals below approximately 1.5 Hz.

5. An infra-sonic detector in accordance with claim 1 wherein said low-pass filter means passes only infra-sonic signals below approximately 1.5 Hz.

* * * * *